US009994948B2

(12) United States Patent
Weidenbach et al.

(10) Patent No.: US 9,994,948 B2
(45) Date of Patent: Jun. 12, 2018

(54) METHOD FOR PRODUCING OXIDE LAYERS WHICH PROTECT AGAINST WEAR AND/OR CORROSION

(71) Applicant: AHC Oberflächentechnik GmbH, Kerpen (DE)

(72) Inventors: Marc Weidenbach, Aachen (DE); Peter Kurze, Augustusburg (DE); Hermann Hans Urlberger, Ratingen (DE)

(73) Assignee: AHC OBERFLÄCHENTECHNIK GMBH, Kerpen (DE)

( * ) Notice: Subject to any disclaimer, the term of this patent is extended or adjusted under 35 U.S.C. 154(b) by 601 days.

(21) Appl. No.: 14/497,783

(22) Filed: Sep. 26, 2014

(65) Prior Publication Data

US 2015/0083277 A1 Mar. 26, 2015

(30) Foreign Application Priority Data

Sep. 26, 2013 (DE) ..... 10 2013 110 659

(51) Int. Cl.

| | |
|---|---|
| ***C23C 8/10*** | (2006.01) |
| ***C23C 8/12*** | (2006.01) |
| ***C23C 8/04*** | (2006.01) |
| ***C23C 8/36*** | (2006.01) |

(52) U.S. Cl.

CPC ..... *C23C 8/12* (2013.01); *C23C 8/04* (2013.01); *C23C 8/36* (2013.01)

(58) Field of Classification Search

CPC .... C23C 8/04; C23C 8/08; C23C 8/10; C23C 8/12; C23C 8/14; C23C 8/16; C23C 8/18; C23C 8/36; C23C 8/38

See application file for complete search history.

(56) References Cited

U.S. PATENT DOCUMENTS 8,029,907 B2 10/2011 Kurze et al.

FOREIGN PATENT DOCUMENTS

| | | |
|---|---|---|
| DE | 10059802 | 6/2002 |
| DE | 10202184 | 5/2003 |
| EP | 1921177 | 5/2008 |
| JP | 59-110784 | 6/1984 |
| WO | 2008/019721 | 2/2008 |

*Primary Examiner* — Lois Zheng

(74) *Attorney, Agent, or Firm* — Harness, Dickey & Pierce, P.L.C.

(57) ABSTRACT

Method for producing oxide layers which protect against wear and/or corrosion on barrier layer-forming metals, preferably aluminum, magnesium and titanium, alloys and mixtures thereof by means of laser treatment, characterized in that on the surface a continuous near-surface oxygen-plasma is produced to form the oxide layer.

1 Claim, 8 Drawing Sheets

METHOD FOR PRODUCING OXIDE LAYERS WHICH PROTECT AGAINST WEAR AND/OR CORROSION

CROSS-REFERENCE TO RELATED APPLICATION

This application claims the benefit and priority of German Patent Application No. 102013110659.5 filed Sep. 26, 2013. The entire disclosure of the above application is incorporated herein by reference.

FIELD

The present disclosure relates to a method for producing oxide layers which protect against wear and/or corrosion on barrier layer-forming metals, preferably aluminium, magnesium and titanium, the alloys and mixtures thereof by means of laser treatment.

BACKGROUND AND SUMMARY

The production of corrosion-resistant or wear-resistant coatings on aluminium is known. Thus with immersion electroplating processes in sulphuric or other acids, high-quality corrosion-resistant and wear-resistant protective layers can be produced by application of external current, these layers being designated as eloxal or hard eloxal layers. Many further subsidiary variations are used in the production of full-surface layers using electrolytes (acids) and external current.

The use of laser technology offers many advantages over an operation requiring the use of an immersion bath.

DE10202184 C1 describes a method for laser-assisted nitriding treatment but the layers obtained are brittle.

DE 102006051709A1 describes a method in which the workpiece surface is remelted by means of laser radiation in the presence of oxygen and a noble gas with no nitrogen or nitrogen-containing media present, and a covering oxidic coating preferably of aluminium oxide (corundum) is produced, being built up thereon. However, no reference is made as to the special requirements which result from the energy balance of the laser treatment itself and the structural measures which are to be taken into consideration during build-up and arrangement of the coating, and the atmosphere must also imperatively be kept free of nitrogen. A similar procedure is disclosed by WO 2008/019721 A1.

According to some embodiments of this disclosure, an alternative method is provided in which oxide layers can be obtained which are hard but not brittle, adhere effectively, have a low level of roughness and protect against wear and/or corrosion.

It has been recognised that when an oxygen plasma is produced at the surface, it is possible to produce oxide layers which are hard but not brittle, adhere effectively, have a low level of roughness and protect against wear and/or corrosion.

For this purpose, plasma is preferably produced by irradiation with a laser. It has proved to be particularly important to ensure that an alloy-dependent maximum intensity is not exceeded by the laser, otherwise, the surface is at risk of being burned. The laser used preferably has an intensity between $5\times10^5$ W/cm$^2$ and $5\times10^6$ W/cm$^2$.

Furthermore, an interaction time between 0.1 s and 0.0001 s has proved to be useful in maintaining the oxygen plasma and producing closed layers.

FIG. 8 very clearly shows the differences over the prior art where plasma is not used. The diagram shows the laser intensity I in W/cm$^2$ over the interaction time t in seconds on aluminium in logarithmic scale divisions. Surface structuring takes place in the region A at the top left, and conversion hardening takes place in the region B at the bottom right.

In the region I in accordance with the present example, between $5\times10^5$ W/cm$^2$ and $5\times10^6$ W/cm$^2$ and between 0.1 s and 0.0001 s (hatched) the reaction of the oxygen plasma with the workpiece melt takes place. Outside this region, either only melting and natural oxidation of the workpiece melt (region II) or evaporation and removal of the workpiece (region III) take place but no controlled reaction between oxygen and the workpiece melt.

In the named prior art, on the one hand sufficient laser intensities are not used and on the other hand the mere stating of laser energy in the case of laser processes is insufficiently specific since only the product of laser intensity and interaction time is thereby stated and therefore the laser intensity and interaction time themselves cannot be specified. Thus, the cited prior art does not operate in the region I in accordance with this example.

It has proved to be particularly advantageous if the surface is irradiated with the laser in a hydrogen-free and anhydrous atmosphere. Stable, laser-assisted, continuous near-surface oxygen plasma can then be generated, in which the oxide layer is formed by the reaction of ionised oxygen and metal. It has specifically and unexpectedly proved to be the case that the oxide layers can be produced in a pore-free and problem-free manner on the surface only and exclusively by maintaining anhydrous, hydrogen-free plasma.

The plasma P consists of reactive oxygen ions O* and must be supplied with energy by the laser L in order to persist. Without the oxygen plasma, the desired oxidic coating will not be produced on the surface despite the melting of the basic material W and oxygen O2 being available. Two reaction partners must be available in the plasma area, on the one hand the ionised oxygen O* and on the other hand the metal, e.g. aluminium, which can then react with the ionised oxygen (cf. FIG. 1). The atmosphere can also contain nitrogen or also noble gas in addition to oxygen.

The conversion phases produced by the laser treatment in accordance with this disclosure in a gas atmosphere are usefully built up in defined strips and combinations thereof under the necessarily ongoing effect of the local plasma.

It is likewise surprising that when travelling down the laser strips in accordance with this disclosure, the remelting region achieved in the region of influence of the plasma MP is deeper than in a region OP worked in a plasma-free manner in spite of having identical specific performance parameters. In the plasma-free area OP absolutely no compact oxide layer is produced in spite of the presence of oxygen (cf. FIG. 2).

The use of noble gasses is not strictly necessary compared with the prior art. It has rather proved to be the case that the formation of the individual, intermittent or combined strips can be adjusted and controlled in terms of thickness and composition by adjusting the nitrogen-oxygen-ratio.

The use of a hydrogen-free and anhydrous gas atmosphere containing only oxygen and nitrogen at the surface is thus preferred.

The gas atmosphere thus preferably contains between 20-100% oxygen, more preferably, greater than or equal to 90%, in particular 95-100% oxygen.

The zero focus (component surface) or a negative focus (in or behind the component) is used as the focus for the laser in order to ensure stable plasma. The position of the focus is important in obtaining and maintaining stable plasma. In the zero focus or negative focus direction (focus is in or behind the component) the plasma is stable. In the positive focus position, the plasma very quickly begins to become unstable and a disproportionately high level of intensity must be applied to obtain plasma. The limit value for the maximum deviation from the focus position is ca. +1/20 the focal width.

The layers thus produced are primarily oxidic in nature but at the same time contain all the alloy components made available by the treated alloy. The material changes produced below the regions closest to the edge are also alloy-dependent.

The functional layer produced is built up of individual or continuous strips which are drawn on the surface by the laser beam. It is absolutely necessary that the described continuous near-surface plasma continues to be maintained (FIG. 3).

The strips can be built up and/or disposed intermittently, in a partially overlapping or fully overlapping manner, in individual strips or strips lying next to one another, in a multiple-offset (interleaved) or inherently structured, hatched or checked manner (FIGS. 4 and 5).

In order to form the strips by the action of a laser, it is also absolutely necessary that an alloy-dependent maximum intensity is maintained (cf. FIG. 8) in order not to burn the workpiece surface to be treated and in order to produce a uniform smooth cover layer. Furthermore, the linear distance between the drawn strips is of particular significance in producing layers which are sealed against corrosion.

Optimum results have been achieved in experiments in the case where the strips overlap by more than 33%. If these relationships cannot be maintained then an optimum result cannot be expected. Thus, in comparison with FIG. 7, FIG. 6 shows that when the distance between strips is too great a continuous layer S is not produced, but rather gaps F occur.

The surface is irradiated with an interaction time of 0.0001 s to 0.1 s, preferably 0.0004 s to 0.001 s. A distance of ca. 0.075 mm with a laser spot size of ca. 0.1 mm in diameter has proved to be the optimal distance between the strips (cf. FIG. 7). When the corresponding relationship is maintained it is possible to deviate from this.

It has unexpectedly been discovered that the remelting zone located below the strips turns out to be harder than in the initial state only in the case of silicon-containing casting materials (AlSi9Cu3 or comparable) but not in the case of the large groups of materials of the forgeable alloys (e.g. 6082, 6061 or comparable) or the copper-containing materials (2024/7075). In the case of the latter, the material structure located below the strips is softer after the treatment than in the initial state. The combinations produced within the extending strips and consisting of material converted and remelted by the action of plasma do not necessarily have to be multi-layer combinations.

DRAWINGS

DETAILED DESCRIPTION

An exemplified method is intended to serve hereinunder to illustrate implementation in accordance with this disclosure: The laser used is a commercially available 400 W fibre laser from IPG-Laser with a wavelength of 1070 nm and a spot diameter in the focus of 0.1 mm. The laser beam is controlled by a scan head of the RHINO type with a focal width of 26 cm from the company Arges.

The method is carried out within a chamber so that an oxygen atmosphere of 95%-100% is used.

The component is in the focus and in order to ensure stable plasma its position should deviate at most by 1/20 of the focal width (in this case −1.3 cm).

The substrate used is AlSi12 with a commercially available ground surface. With this alloy, intensities of $5\times10^5$ W/cm$^2$ to $1.5\times10^6$ W/cm$^2$ can be applied. Below this intensity no plasma is produced and above it the material begins to burn, the plasma is discoloured to white and a rough non-uniform layer is produced. For the example, an intensity of $1.5\times10^6$ W/cm$^2$ was used.

Possible interaction times are 0.1 s to 0.0001 s, wherein in this case an interaction time of 0.0004 s was applied. The interaction time influences the duration of the process and the layer thickness to be achieved. If the interaction time is too short, no plasma is produced or it breaks down during the process or a very thin (<1 μm) defective layer is produced.

Figure 1:
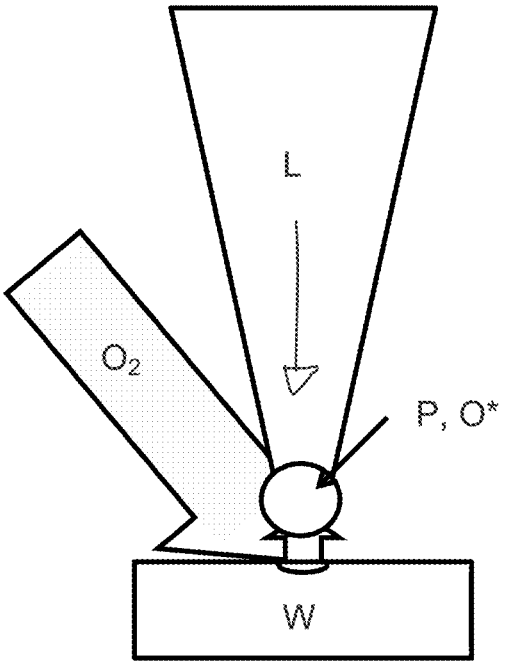
FIG. 1 is a schematic drawing showing how the laser and oxygen interact and the basic material to form the plasma.
Figure 2:
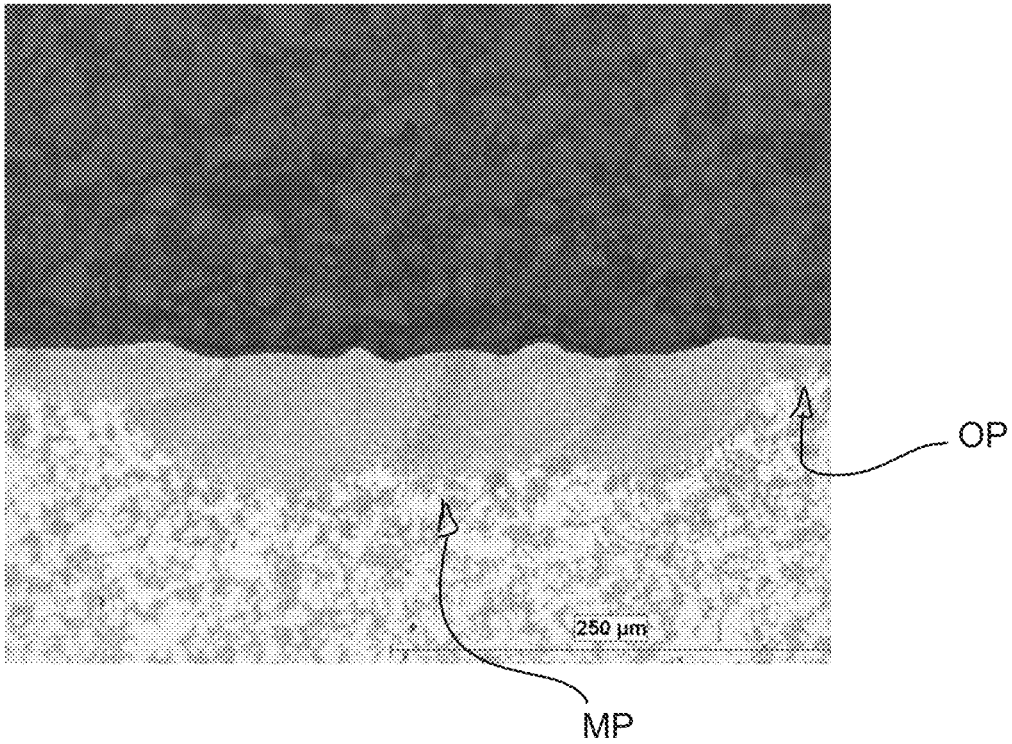
FIG. 2 is a cross-section showing the difference of the influence of the plasma with the plasma-free regions.
Figure 3:
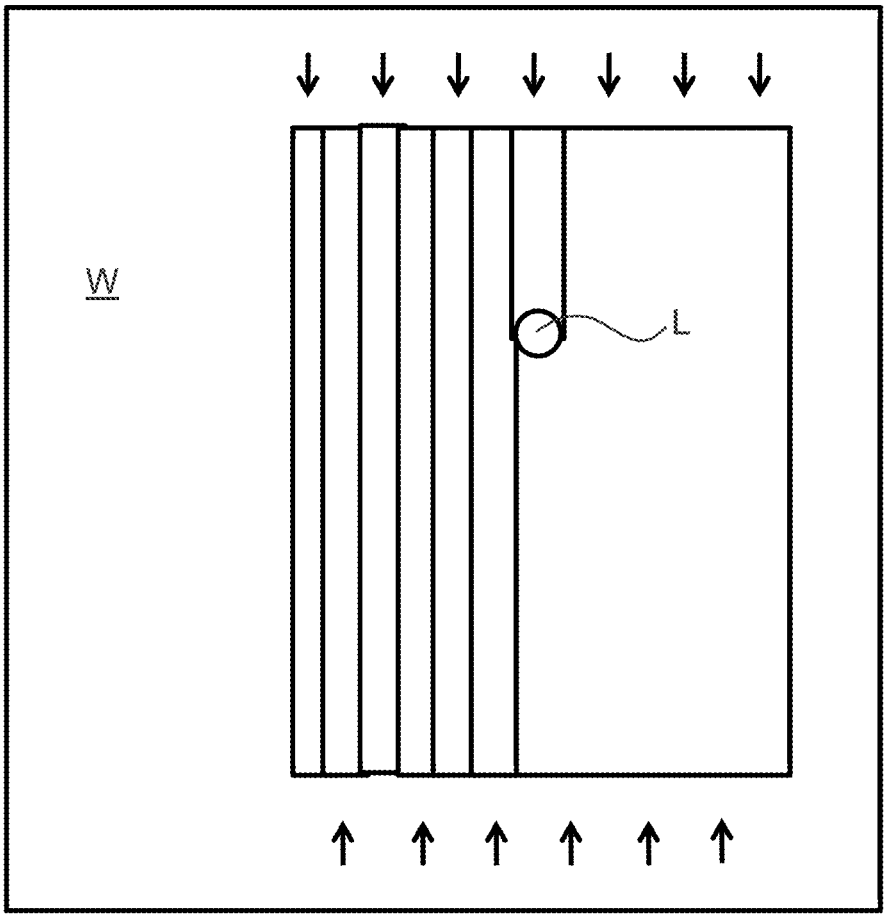
FIG. 3 is a schematic drawing showing a process for functional layer production using the plasma.
Figure 4:
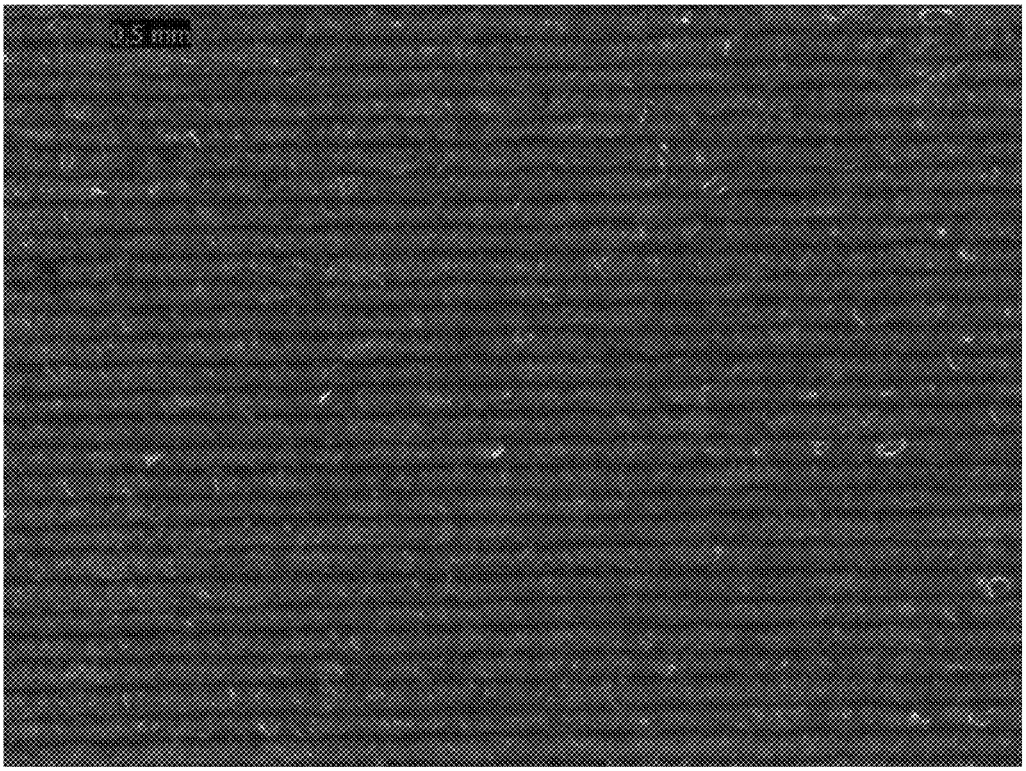
FIG. 4 and FIG. 5 show surfaces achieved by interleaved or hatched laser interaction with the surface.
Figure 5:
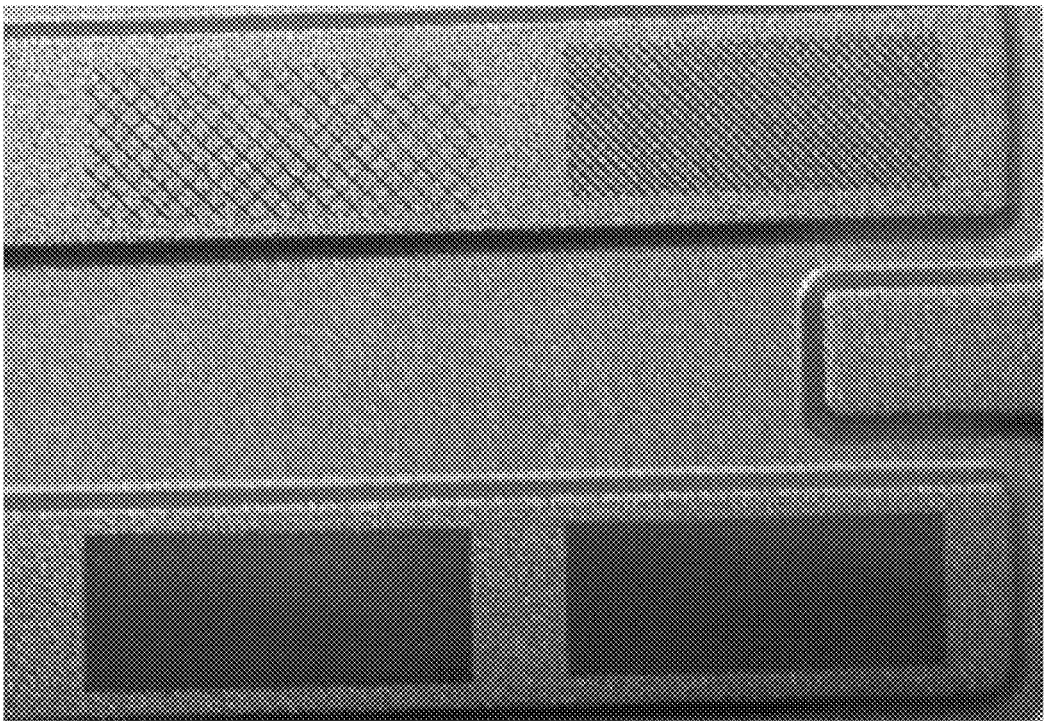
Figure 6:
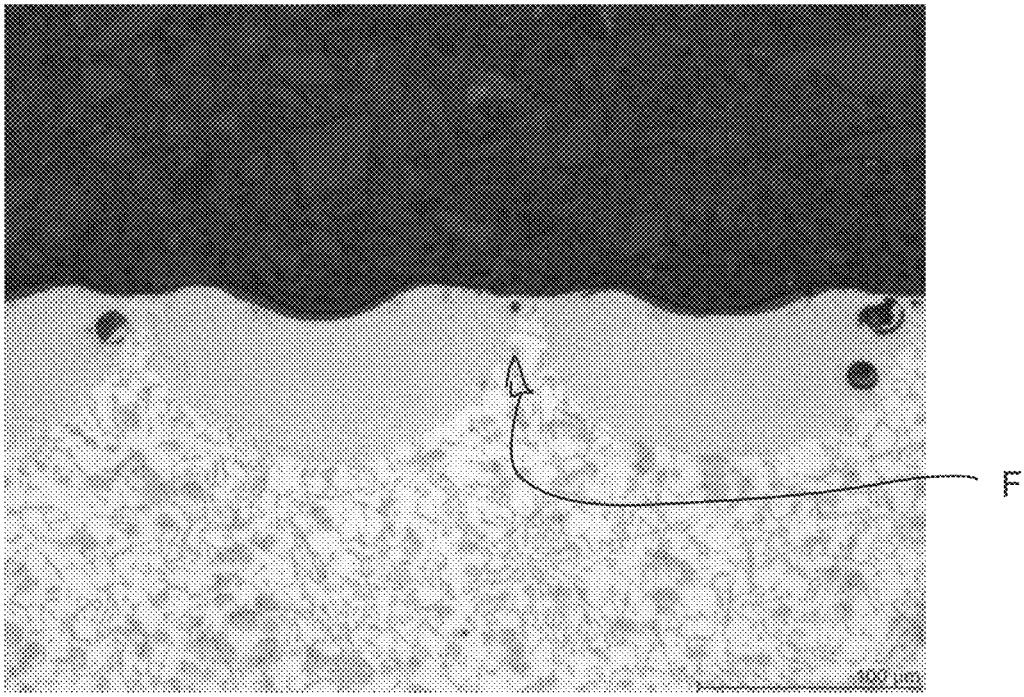
FIG. 6 is a section view with the distance between strips of laser interaction of 0.175 mm.
Figure 7:
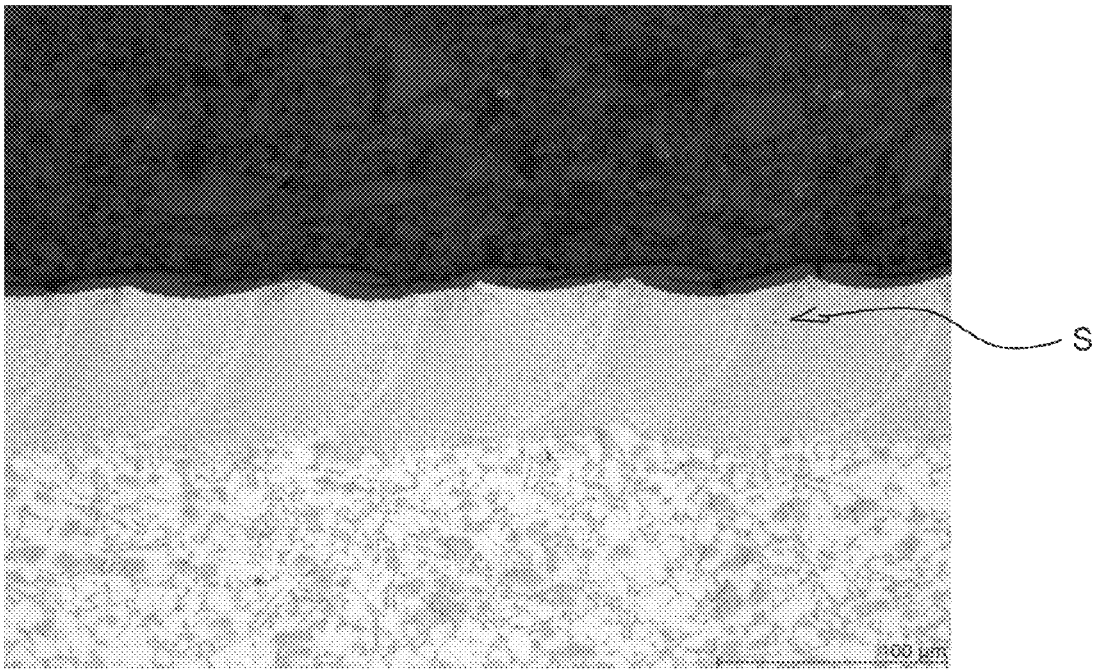
FIG. 7 is a section view of strips of laser interaction with the distance between the strips of 0.075 mm according to this disclosure.
Figure 8:
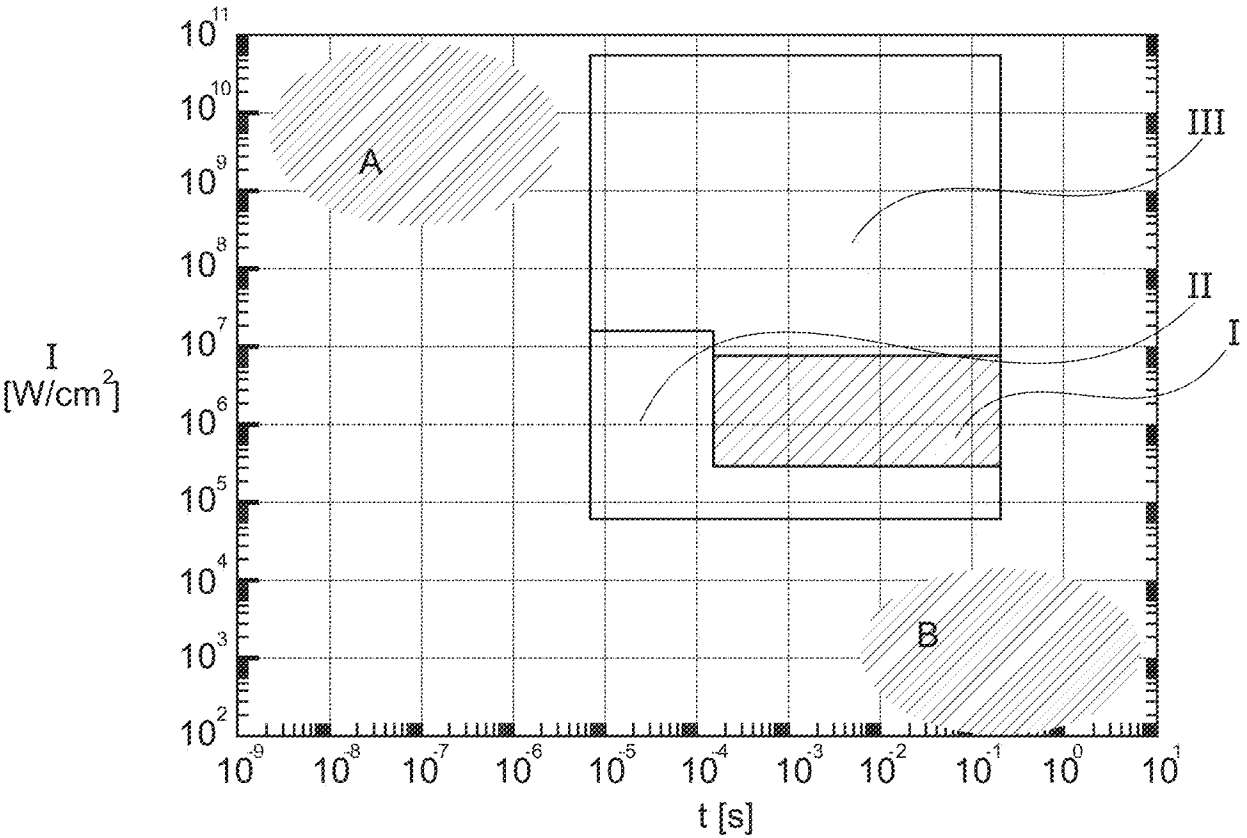
FIG. 8 is a diagram of intensity in W/cm$^2$ of an interaction time in seconds with a logarithmic scale showing the region I in accordance with this disclosure.

The distance between the individual strips when travelling down the surface of the substrate with the laser is 0.075 mm for this example in order to produce a closed layer (cf. FIG. 7).

When selecting these parameters, 6400 J/cm$^2$ laser power is applied to the material, whereby plasma is generated which produces a closed layer on the substrate by conversion of oxygen and aluminium to form corundum, the layer having a thickness between 3 and 6 μm and a roughness depth <2 μm.

COMPARATIVE EXAMPLE

If, when using the same laser parameters, an interaction time of 0.00002 s is selected, no oxygen plasma is produced over the substrate and only remelting of the aluminium alloy takes place despite sufficient oxygen and sufficient laser intensity.

The invention claimed is:

1. A method for producing oxide layers which protect against wear and/or corrosion on barrier layer-forming metals, comprising:

irradiating a surface of a metal with a laser within an atmosphere to produce a continuous and near-surface oxygen plasma on the surface of said metal to form an oxide layer in which irradiation of said surface takes place with an interaction time between 0.0001 s and 0.1 s and a laser intensity between $5\times10^5$ W/cm$^2$ and $5\times10^6$ W/cm$^2$, and wherein the position of the workpiece does not deviate by more than 1/20 of focal width from focus, and also does so only in a negative focus direction.

* * * * *